US011441254B2

(12) United States Patent
Kim

(10) Patent No.: US 11,441,254 B2
(45) Date of Patent: Sep. 13, 2022

(54) WASHING MACHINE AND METHOD FOR CONTROLLING THE SAME

(71) Applicant: LG ELECTRONICS INC., Seoul (KR)

(72) Inventor: Junghun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 155 days.

(21) Appl. No.: 16/283,372

(22) Filed: Feb. 22, 2019

(65) Prior Publication Data

US 2019/0264367 A1 Aug. 29, 2019

(30) Foreign Application Priority Data

Feb. 26, 2018 (KR) ..... 10-2018-0022916

(51) Int. Cl.

| | |
|---|---|
| ***D06F 33/40*** | (2020.01) |
| ***D06F 33/47*** | (2020.01) |
| ***D06F 37/22*** | (2006.01) |
| ***D06F 35/00*** | (2006.01) |
| ***D06F 103/26*** | (2020.01) |
| ***D06F 103/24*** | (2020.01) |
| ***D06F 103/46*** | (2020.01) |

(Continued)

(52) U.S. Cl.

CPC ..... *D06F 33/40* (2020.02); *D06F 33/47* (2020.02); *D06F 35/007* (2013.01); *D06F 37/22* (2013.01); *D06F 39/06* (2013.01); *D06F 2103/24* (2020.02); *D06F 2103/26* (2020.02); *D06F 2103/46* (2020.02); *D06F 2105/48* (2020.02); *D06F 2105/52* (2020.02)

(58) Field of Classification Search

CPC ..... D06F 33/40; D06F 33/47; D06F 33/60; D06F 33/74; D06F 35/007; D06F 39/06; D06F 2103/24; D06F 2103/26; D06F 2103/46; D06F 2105/48; D06F 2105/52

See application file for complete search history.

(56) References Cited

U.S. PATENT DOCUMENTS

2012/0198633 A1* 8/2012 Jang ..... D06F 33/40 8/137
2018/0155862 A1* 6/2018 Kawaguchi ..... D06F 23/04

FOREIGN PATENT DOCUMENTS

JP 2001212397 A * 8/2001
KR 10-2011-0022493 3/2011

(Continued)

OTHER PUBLICATIONS

English translation of KR10-2011-0022495.*

(Continued)

*Primary Examiner* — Joseph L. Perrin
(74) *Attorney, Agent, or Firm* — KED & Associates LLP

(57) ABSTRACT

A method of controlling a washing machine includes starting driving of a motor for rotating a drum and increasing a rotation speed of the motor to a first rotation speed, increasing the rotation speed of the motor from the first rotation speed to a second rotation speed, after the rotation speed of the motor have increased to the first rotation speed, and determining whether bubbles have been generated in the drum while the rotation speed of the motor increases to the second rotation speed. A difference between the second rotation speed and the first rotation speed is greater than the first rotation speed.

7 Claims, 7 Drawing Sheets

(51) Int. Cl.

| | |
|---|---|
| ***D06F 105/52*** | (2020.01) |
| ***D06F 105/48*** | (2020.01) |
| ***D06F 39/06*** | (2006.01) |

(56) References Cited

FOREIGN PATENT DOCUMENTS

| | | | |
|---|---|---|---|
| KR | 10-2011-0022495 | * | 3/2011 |
| WO | WO2016/156069 A1 | * | 10/2016 |

OTHER PUBLICATIONS

Machine translation of JP-2001212397-A to SHU. (Year: 2001).*
Korean Office Action dated Feb. 14, 2022 issued in KR Application No. 10-2018-0022916.

* cited by examiner

WASHING MACHINE AND METHOD FOR CONTROLLING THE SAME

CROSS-REFERENCE TO RELATED APPLICATION(S)

The present application claims the benefit of priority under 35 U.S.C. 119 and 35 U.S.C. 365 to Korean Patent Application No. 10-2018-0022916, filed in Korea on Feb. 26, 2018, the contents of all of which are hereby incorporated by reference in their entireties.

FIELD

The present specification relates to a washing machine and a method of controlling the same.

BACKGROUND

In general, a washing machine refers to an apparatus for treating laundry through various cycles such as washing, dehydration and/or drying. The washing machine may include an outer tub, in which water is contained, and a drum (or an inner tub) rotatably provided in the outer tub and provided with a plurality of through-holes, through which water passes.

The washing machine may include a top load type washing machine in which laundry (or clothes) is put from the upper side of a cabinet of the washing machine and an inner tub is rotated about a vertical axis and a front load type washing machine in which laundry is put from the front side of s cabinet of the washing machine and an inner tub (or a drum) is rotated about a horizontal axis.

When a user selects a desired course using a control panel in a state in which laundry such as clothes or bedclothes is put in the drum, such a washing machine performs a preset algorithm in correspondence with the selected course, thereby performing water supply/drainage, washing, rinsing, dehydration, etc.

Operation of the washing machine is generally divided into a washing cycle, a rinsing cycle and a dehydration cycle. Progress of such cycles may be checked on a display provided in the control panel.

The washing cycle refers to a cycle for supplying detergent into the drum together with water to remove contaminants adhered to the laundry using a chemical action of the detergent and a physical action by rotation of a pulsator and/or the drum.

The rinsing cycle refers to a cycle for supplying clean water, in which detergent is not dissolved, into the drum to rinse laundry. In particular, the rinsing cycle may remove the detergent absorbed in the laundry during the washing cycle. Meanwhile, at the time of the rinsing cycle, a fabric softener may be supplied into the drum together with water.

The dehydration cycle refers to a cycle for rotating the drum at a high speed after the rinsing cycle is finished. In general, operation of the washing machine may be finished by completing the dehydration cycle. However, a washing machine having a drying function may further include a drying cycle after the dehydration cycle.

Korean Patent Laid-open Publication No. 2011-0022495 (published on Mar. 7, 2011) discloses a method of controlling a dehydration cycle of a washing machine.

Meanwhile, as a dehydration cycle starts, the rotation speed (RPM) of a motor increases. As centrifugal force is applied to laundry and residual moisture of the laundry, the detergent escapes from the laundry, thereby generating bubbles.

At this time, bubbles act as resistance against rotation of the drum, which makes it difficult for the motor to rotate at a set rotation speed in the dehydration cycle. That is, efficiency of the dehydration cycle is lowered due to generation of bubbles.

In addition, in a process of gradually increasing the rotation speed of the motor, bubbles may be excessively generated in the drum, thereby being leaked.

SUMMARY

Embodiments provide a washing machine capable of improving efficiency of a dehydration cycle, and a method of controlling the same.

Embodiments provide a washing machine capable of improving efficiency of a dehydration cycle by detecting and removing bubbles generated in a drum, and a method of controlling the same.

Embodiments provide a washing machine capable of reducing leakage of bubbles in a high-speed dehydration period, and a method of controlling the same.

In one embodiment, a method of controlling a washing machine includes starting driving of a motor for rotating a drum and increasing a rotation speed of the motor to a first rotation speed, increasing the rotation speed of the motor from the first rotation speed to a second rotation speed, after the rotation speed of the motor have increased to the first rotation speed, and determining whether bubbles have been generated in the drum while the rotation speed of the motor increases to the second rotation speed. A difference between the second rotation speed and the first rotation speed is greater than the first rotation speed.

In another embodiment, a washing machine includes a drum, a motor configured to rotate the drum, a motor controller configured to control a rotation speed of the motor, and a microcomputer configured to determine whether bubbles have been generated while the drum rotates. In a dehydration cycle, after the rotation speed of the motor increases to a first rotation speed, the microcomputer determines whether bubbles have been generated in the drum while the rotation speed of the motor increases to a second rotation speed greater than the first rotation speed. A difference between the second rotation speed and the first rotation speed is greater than the first rotation speed.

DETAILED DESCRIPTION OF THE EMBODIMENTS

Exemplary embodiments of the present invention will be described below in detail with reference to the accompanying drawings in which the same reference numbers are used throughout this specification to refer to the same or like parts. In describing the present invention, a detailed description of known functions and configurations will be omitted when it may obscure the subject matter of the present invention.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It will be understood that when one element is referred to as being "connected to", "coupled to", or "accessed to" another element, one element may be "connected to", "coupled to", or "accessed to" another element via a further element although one element may be directly connected to or directly accessed to another element.

Figure 1:
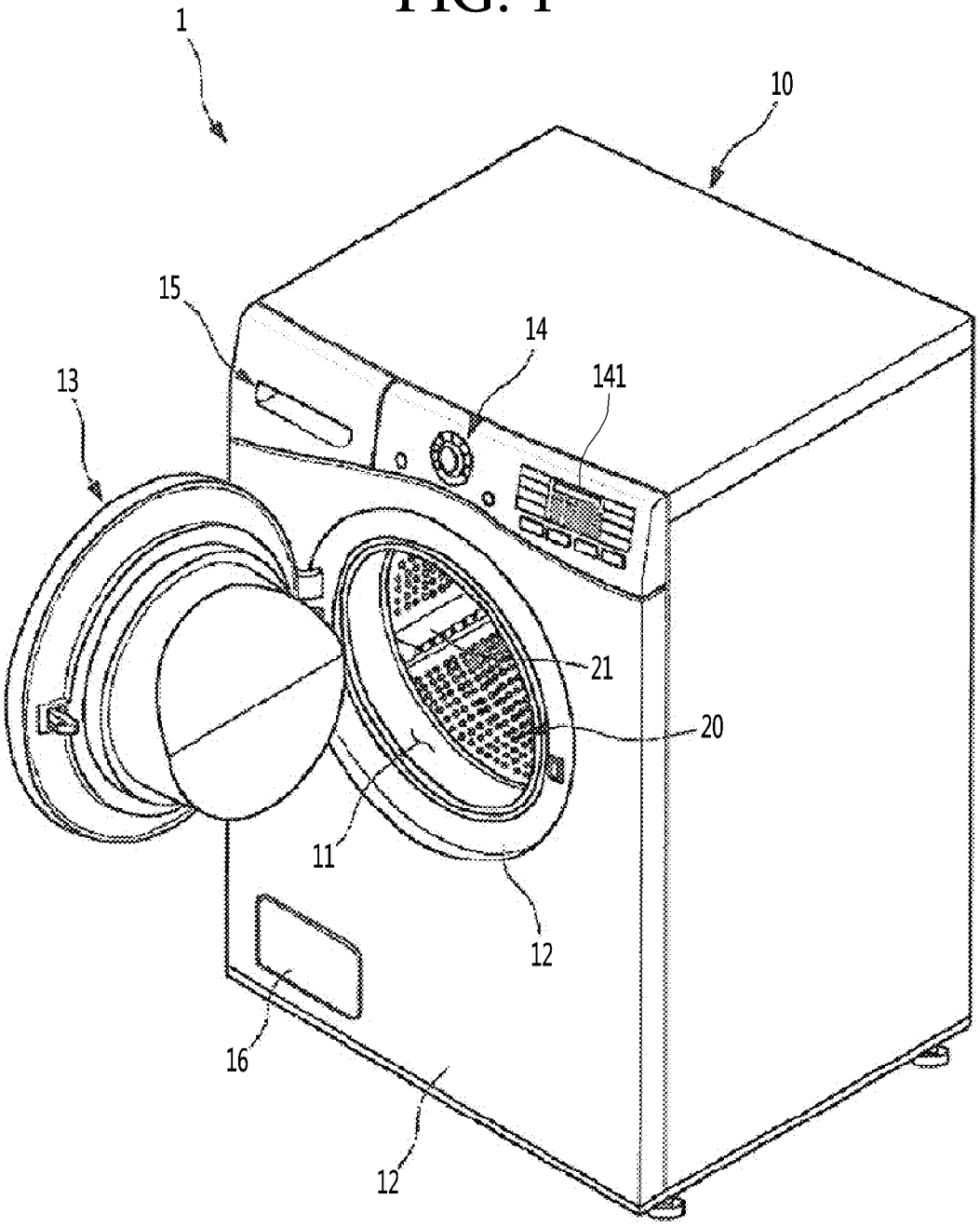
FIG. 1 is a perspective view of a washing machine according to an embodiment of the present invention.
Figure 2:
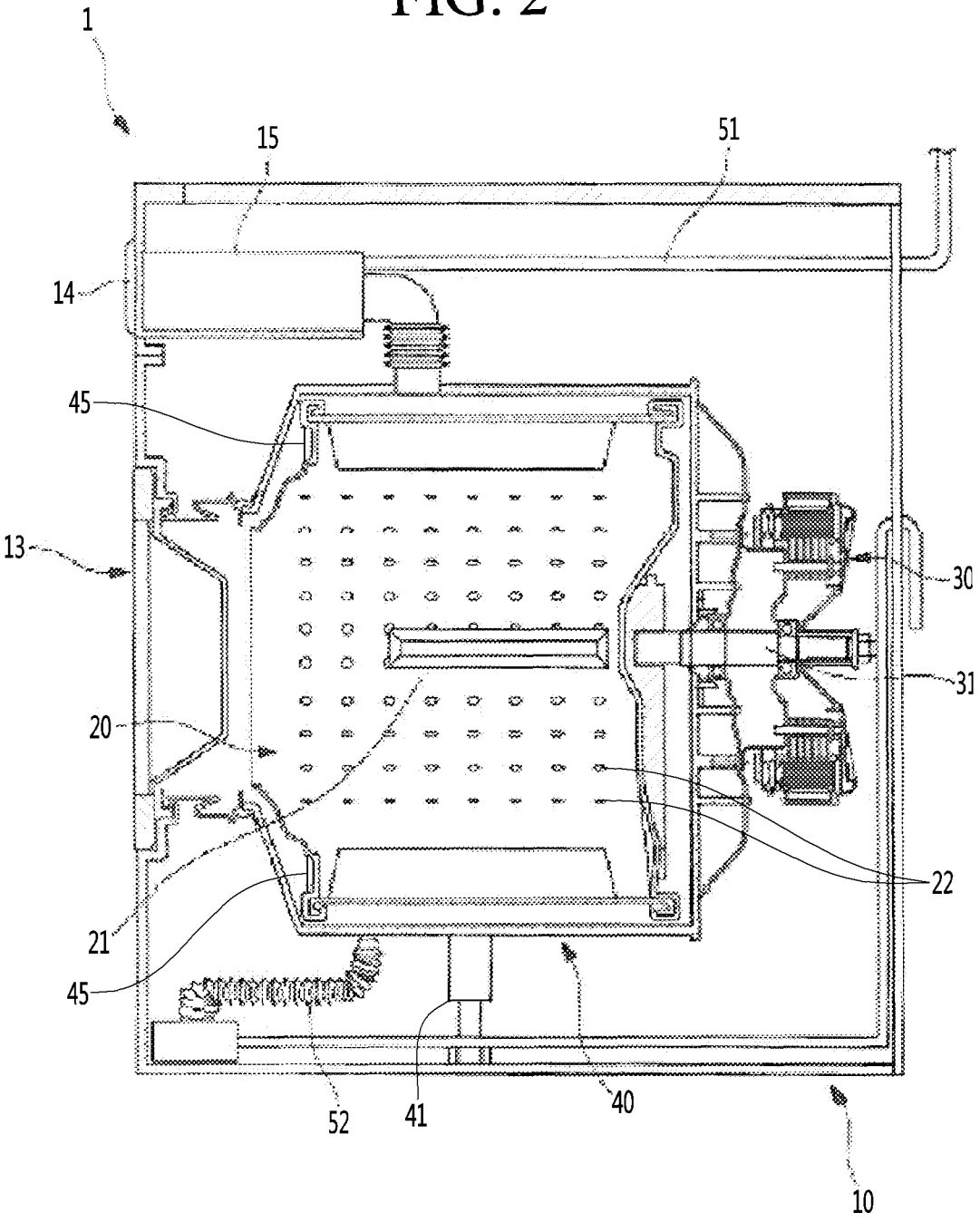
FIG. 2 is a longitudinal cross-sectional view of the washing machine according to an embodiment.

FIG. 1 is a perspective view of a washing machine according to an embodiment of the present invention, and FIG. 2 is a longitudinal cross-sectional view of the washing machine according to an embodiment.

Referring to FIGS. 1 and 2, the washing machine 1 according to the embodiment of the present invention may include a cabinet 10 forming appearance thereof, a front cover 12 mounted in a front surface of the cabinet 10 and having a laundry inlet 11 formed therein, and a drum 20 in which the laundry is received.

In addition, the washing machine 1 may further include a motor 30 for providing rotation power to the drum 20 and a tub 40 in which the drum 20 and the motor 30 are received.

The cabinet 10 may have a substantially hexahedral shape. In addition, a space where a plurality of parts is provided may be formed in the cabinet 10 of the washing machine 1. The plurality of parts may include elements for controlling the drum 20, the motor 30, and the tub 40, for example.

The laundry inlet 11 may be formed in the front cover 12. The laundry inlet 11 may be substantially formed at the central portion of the front cover 12. In addition, a door 13 for opening and closing the laundry inlet 11 may be rotatably provided in the front cover 12.

A gasket (not shown) may be provided between the door 13 and the tub 40, maintaining gas tight.

The washing machine 1 may further include a control panel 14 provided on the upper end of the front surface of the cabinet 10. The control panel 14 may include a display 141 for displaying the operation state of the washing machine 1. The control panel 14 may be provided with a plurality of buttons or knobs for operating the washing machine 1.

The washing machine 1 may further include a detergent drawer 15 provided in the upper end of the front surface of the cabinet 10. The detergent drawer 15 may be provided beside the control panel 14. The detergent drawer 15 may include a portion, in which detergent is put and stored, and a portion exposed to the front surface, both of which are integrally formed.

The detergent drawer 15 may be connected with a water supply pipe (51 of FIG. 2), through which cold/hot water is supplied. Cold/hot water may flow from the water supply pipe 51 into the detergent drawer 15. In addition, water mixed with at least one of the detergent and fabric softener of the detergent drawer 15 may be supplied into the drum 20, in which the laundry is received, through the tub 40.

The washing machine 1 may further include a service cover 16 provided in a lower end of the front surface of the cabinet 10. The service cover 16 is configured to be opened in a state in which the washing machine 1 is stopped, thereby removing water remaining in the washing machine 1.

The drum 20 may have a substantially cylindrical shape. The motor 30 may be fixed to the tub 40. A driving shaft 31 provided horizontally with respect to the tub 40 may be coupled to the motor 30. In addition, the driving shaft 31 may penetrate the drum 20.

Accordingly, when the driving shaft 31 rotates by driving the motor 30, the drum 20 received in the tub 40 may also rotate along with the driving shaft 31. Washing water may flow into the tub 40. At this time, the tub 40 may have airtightness such that the washing water is not leaked from the tub 40.

An opening for putting the laundry may be formed at one side of the drum 20. The position of the opening may correspond to the position of the laundry inlet 11. The opening may be opened or closed by rotation of the door 13.

The door 13 and the positional relationship between the drum 20 and the door 13 are summarized as follows. The door 13 may be located on one side of the drum 20, and the driving shaft 31 connected to the motor 30 may be located on the opposite side of the door 13 with respect to the drum 20.

Meanwhile, the washing machine 1 may further include a lifter 21 provided on the inner side of the drum 20. The lifter 21 may extend in the front-and-rear direction (the left-and-right direction of the drawing) of the drum 20.

In addition, the lifter 21 may have a shape protruding from the inner surface of the drum 20 to the inside of the drum 20 at a predetermined height. In addition, a plurality of lifters 21 may be provided. At this time, the plurality of lifters 21 may be spaced apart from each other along the circumferential direction of the drum 20 at a predetermined interval. Accordingly, when the drum 20 rotates, the lifter 21 may lift up the laundry such that the laundry falls from a predetermined height by gravity.

A plurality of through-holes 22 may be formed in the drum 20. Washing water flowing into the tub 40 may flow into the drum 20 through the through-holes 22. In addition, at the time of dehydration after a washing cycle, the washing water contained in the drum 20 may be drained to the tub 40 through the through-holes 22. At this time, the washing water flowing into the tub 40 may be drained to the outside of the cabinet 10 through a drain pipe 52.

A damper 41 for attenuating vibration of the tub 40 may be provided between the outer circumferential surface of the tub 40 and the cabinet 10.

Figure 3:
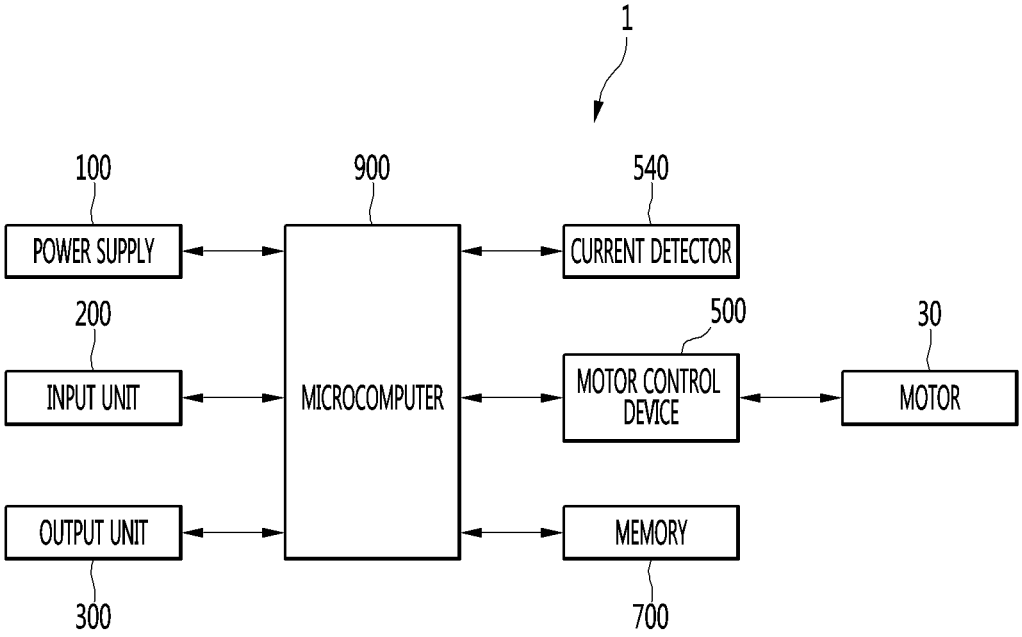
FIG. 3 is a block diagram showing the control configuration of a washing machine according to an embodiment.

FIG. 3 is a block diagram showing the control configuration of a washing machine according to an embodiment.

Referring to FIG. 3, the washing machine 1 may include a power supply 100.

The power supply 100 may convert commercial power into power suitable for each control configuration of the washing machine 1 and then supply the converted power to each control configuration of the washing machine 1. For example, the power supply 100 may include a rectifier (or a rectification circuit).

The washing machine 1 may include an input unit 200 for inputting a washing control command and an output unit 300 for displaying a screen corresponding to the input command. The input unit 200 may include a plurality of buttons or knobs provided on the control panel 14. In addition, the output unit 300 may include a display 141 of the control panel 14.

The washing machine 1 may further include a current detector 540 supplied to the motor 30. Output current measured by the current detector 540 may be transmitted to a microcomputer 900 for controlling the motor control device 500.

The microcomputer 900 may check whether bubbles have been generated in the drum 20 based on the received output current. Specifically, the microcomputer 900 may check the amount of bubbles generated in the drum 20 using the maximum value imax of the output current received during a set time. Checking of the amount of bubbles generated in the drum 20 by the microcomputer 900 will be described in detail below.

The washing machine 1 may further include the motor control device 500 capable of detecting at least one of the rotation speed of the motor 30 and whether the drum 20 is eccentric (unbalanced).

The motor control device 500 may measure the output current applied to the motor 30 at an inverter 530 and calculate the current rotation speed (rpm) (hereinafter referred to as a current speed) of the motor 30.

In addition, the motor control device 500 may check whether the drum 20 is eccentric using a difference between a set speed for driving the motor 30 and the current speed.

Of course, in another embodiment, a separate sensor may be provided to detect whether the drum 20 is eccentric. For example, a vibration sensor may be provided in the drum 20 or the cabinet 10 and, when the amount of vibration measured by the vibration sensor is equal to or greater than a set amount, it may be determined that the drum 20 is eccentric.

Meanwhile, the washing machine 1 may further include a memory 700. In addition, the washing machine 1 may further include the microcomputer 900 for controlling each configuration of the washing machine 1 to perform a result corresponding to an input command by referring to the memory 700.

Information on the rotation speed of the motor 30 corresponding to a dehydration cycle level may be prestored in the memory 700 through the input unit 200. For example, as an input dehydration cycle level decreases, the rotation speed of the motor 30 may decrease.

The information on the rotation speed may be divided into a plurality of rotation speed values and stored.

Specifically, the information on the rotation speed may include a first rotation speed for detecting eccentricity of the drum 20 at the time of an initial dehydration cycle.

While the rotation speed of the motor 30 reaches the first rotation speed, the microcomputer 900 may control the motor control device 500 to check whether the drum 20 is eccentric. The first rotation speed may be 100 rpm or more. The first rotation speed may be, for example, 108 rpm, although not limited thereto.

In addition, the information on the rotation speed may further include a second rotation speed greater than the first rotation speed.

Upon determining that the drum 20 is not eccentric, the microcomputer 900 may control the motor control device 500 to rotate the motor 30 at the second rotation speed. While the motor 30 is driven at the second rotation speed, residual moisture remaining in the laundry in the drum 20 may be removed by centrifugal force. The second rotation speed may be 400 rpm or more. The second rotation speed may be, for example, 450 rpm, although not limited thereto. Accordingly, a difference between the second rotation speed and the first rotation speed is greater than the first rotation speed. The second rotation speed is equal to or greater than three times the first rotation speed.

In addition, the information on the rotation speed may further include a third rotation speed greater than the second rotation speed.

After the motor 30 is driven at the second rotation speed during a set time, the microcomputer 900 may increase the rotation speed of the motor 30 at the third rotation speed or more. The third rotation speed may be 600 rpm, for example.

Accordingly, a difference between the first rotation speed and the second rotation speed is greater than a difference between the second rotation speed and the third rotation speed.

In a period in which the motor 30 is driven at the second rotation speed, residual moisture which is not removed from the laundry may be removed when the rotation speed of the motor 30 increases to the third rotation speed or more.

In summary, when the motor 30 is accelerated to the second rotation speed or is rotated at a constant speed, residual moisture contained in the laundry in the drum 20 may be primarily removed. In addition, while the motor 30 is accelerated to the third rotation speed or more, moisture contained in the laundry may be secondarily removed.

Since the motor 30 rotates at the third rotation speed in a state in which the weight of the drum 20 is reduced, it is possible to stably perform dehydration in a state in which balance of the laundry in the drum 20 is maintained.

Meanwhile, set current for recognizing that bubbles have been generated in the drum 20 according to the rotation speed of the motor may be stored in the memory 700. The set current may be predetermined by a user.

For example, in a process of determining whether bubbles have been generated, the microcomputer 900 may compare output current applied to the motor 30 with the set current corresponding to the current speed of the motor 30 to detect bubbles in the drum 20.

Current information for determining the amount of bubbles in the drum 20 may be stored in the memory 700. The microcomputer 900 may compare the current information with the current value measured by the current detector 540 to check whether bubbles have been generated in the drum 20.

For example, when the measured current value is greater than the set current value, the microcomputer 900 may determine that bubbles have been generated in the drum 20 and perform a bubble removal algorithm.

In addition, the bubble removal algorithm for reducing bubbles in the drum 20 may be stored in the memory 700.

The bubble removal algorithm may mean that water is supplied in a state in which rotation of the drum 20 is stopped, the drum is rotated to remove bubbles, and dehydration is performed. Upon determining that bubbles have been removed through dehydration, the microcomputer 900 may perform control to stop the bubble removal algorithm and to return to an original cycle. Of course, upon determining that bubble have not been removed, the bubble removal algorithm may be repeatedly performed.

A resonance band avoidance algorithm for reducing eccentricity generated in the drum 20 may be stored in the memory 700. Upon recognizing that the drum 20 is eccentric, the microcomputer 900 may determine that the rotation speed of the motor 30 enters a resonance band.

In addition, the microcomputer 900 may perform the resonance band avoidance algorithm by referring to the memory 700. In the resonance band avoidance algorithm, the microcomputer 900 may check whether the drum 20 is eccentric while decreasing or increasing the rotation speed of the motor 30 by a set speed. In addition, when rotation of the drum 20 is balanced, it may be determined that the rotation speed of the motor deviates from the resonance band.

Hereinafter, the detailed configuration of the motor control device 500 for controlling the motor 30 will be described.

Figure 4:
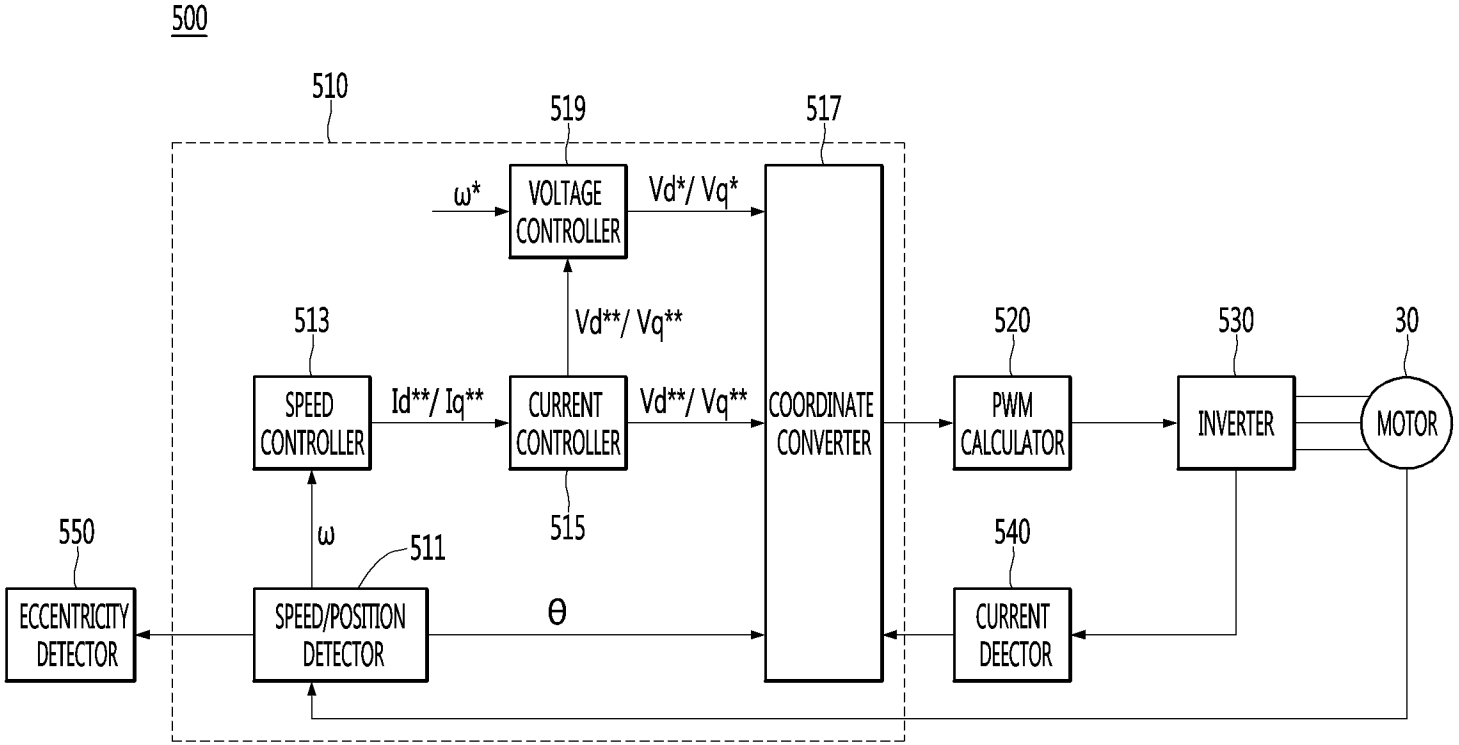
FIG. 4 is a block diagram showing the control configuration of a motor control device of a washing machine according to an embodiment.

FIG. 4 is a block diagram showing the control configuration of the motor control device according to the embodiment.

Referring to FIG. 4, the motor control device 500 may include at least one of a motor controller 510, a PWM calculator 520, the current detector 540 and an eccentricity detector 550.

The motor controller 510 may control power input to the motor 30. The motor controller 510 may include at least one of a voltage controller 519, a speed/position detector 511, a speed controller 513, a current controller 515 and a coordinate converter 517.

The voltage controller 519 may output a command voltage value for a command speed. The command voltage value for each command speed obtained experimentally may be stored in the voltage controller 519.

In addition, the voltage controller 519 may store the command voltage value for the command speed for each rotation direction of the drum 20. In addition, the voltage controller 519 may store the command voltage value for the command speed according to the amount of laundry (or the amount of clothes) contained in the drum 20.

A d-axis command voltage value and a q-axis command voltage value on a dq-axis rotating coordinate system defined by a d-axis parallel to a magnetic flux direction and a q-axis perpendicular to the magnetic flux direction of a permanent magnet may be stored in the voltage controller 519. In addition, the voltage controller 519 may transmit (or output) a d-axis command voltage value and a q-axis command voltage value to the coordinate converter 517, when the command speed is requested. The voltage controller 519 may newly store the command voltage value for the command speed and output the newly stored command voltage value when the same command speed is input.

The coordinate converter 517 may convert a dq-axis rotating coordinate system and a uvw fixed coordinate system into each other. The coordinate converter 517 may convert a command voltage value input to the dq-axis rotating coordinate system into a three-phase command voltage value. In addition, the coordinate converter 517 may convert the current (or the presently measured current) of the fixed coordinate system detected by the current detector 540 into the dq-axis rotating coordinate system. The coordinate converter 517 may receive the position 0 of a rotor detected by the speed/position detector 511 and convert the coordinate system.

The PWM calculator may receive the signal of the uvw fixed coordinate system output from the coordinate converter 517 of the motor controller 510 and generate a PWM signal. In addition, the inverter 530 may receive the PWM signal from the PWM calculator 520 and directly control power (i.e., control output current from the inverter 530) input to the motor 30. Meanwhile, the current detector 540 may detect (or measure) the output current output from the inverter 530 to the motor 30. Although the PWM calculator 520 is described as being separated from the inverter 530 in the present embodiment, the PWM calculator 520 may be included in the inverter 530 in another embodiment.

The speed/position detector 511 may detect the rotation speed and position of the rotor of the motor 30. The speed/position detector 511 may detect the rotation speed and position of the rotor by the position of the rotor detected by a Hall sensor (not shown).

The speed controller 513 may perform proportional integral differential (PID) control with respect to the rotation speed of the rotor detected by the speed/position detector 511 to generate the d-axis command present value and the q-axis command current value on the dq-axis rotating coordinate system, thereby estimating the command speed through the rotation speed. When the rotation speed of the rotor detected by the speed/position detector 511 is maintained with slight fluctuation, the speed controller 513 may compare the average value of the fluctuated values with the command speed.

The current controller 515 may perform PID control with respect to the current detected by the current detector 540, thereby generating the d-axis command voltage value and the q axis command voltage.

The eccentricity detector 550 may measure a degree of eccentricity (or a degree of unbalancing) of the drum 20 through the rotation speed of the rotor detected by the speed/position detector 511. The eccentricity detector 550 may measure change in rotation speed of the rotor to measure the degree of eccentricity.

While the drum 20 is accelerated to the first rotation speed or is rotated at a constant speed, if the drum 20 is eccentric, the eccentricity detector 550 may measure the degree of eccentricity of the drum 20 based on the rotation speed of the rotor.

The eccentricity detector 550 may measure the degree of eccentricity using a difference between the change in rotation speed of the rotor and a reference speed change (or a set speed change) prestored in the memory 700. The reference speed change may be differently stored according to the amount of laundry (the amount of clothes). Since the difference between change in rotation speed of the rotor and the reference speed change is changed with time, the eccentricity detector 550 may calculate an average of a maximum value and a minimum value of the difference between the change in rotation speed of the rotor and the reference speed change as the degree of eccentricity.

In the present embodiment, the rotation speed of the motor 30 is calculated using the rotation speed of the rotor. Meanwhile, in another embodiment, the speed/position detector 511 may detect the rotation speed of the motor 30 through current detected by the current detector 540. In this case, the degree of eccentricity of the drum 20 may be measured based on the current rotation speed of the motor 30 measured through the current detector 540 and the rotation speed input to the motor 30 (or the set rotation speed stored in the memory 700) through the current detector 540. At this time, it may be understood that, as the difference increases, the degree of eccentricity of the drum 20 may increase.

<Method of Controlling Washing Machine Which is Capable of Reducing Phenomenon Wherein Bubbles are Generated in the Drum>

Figure 5:
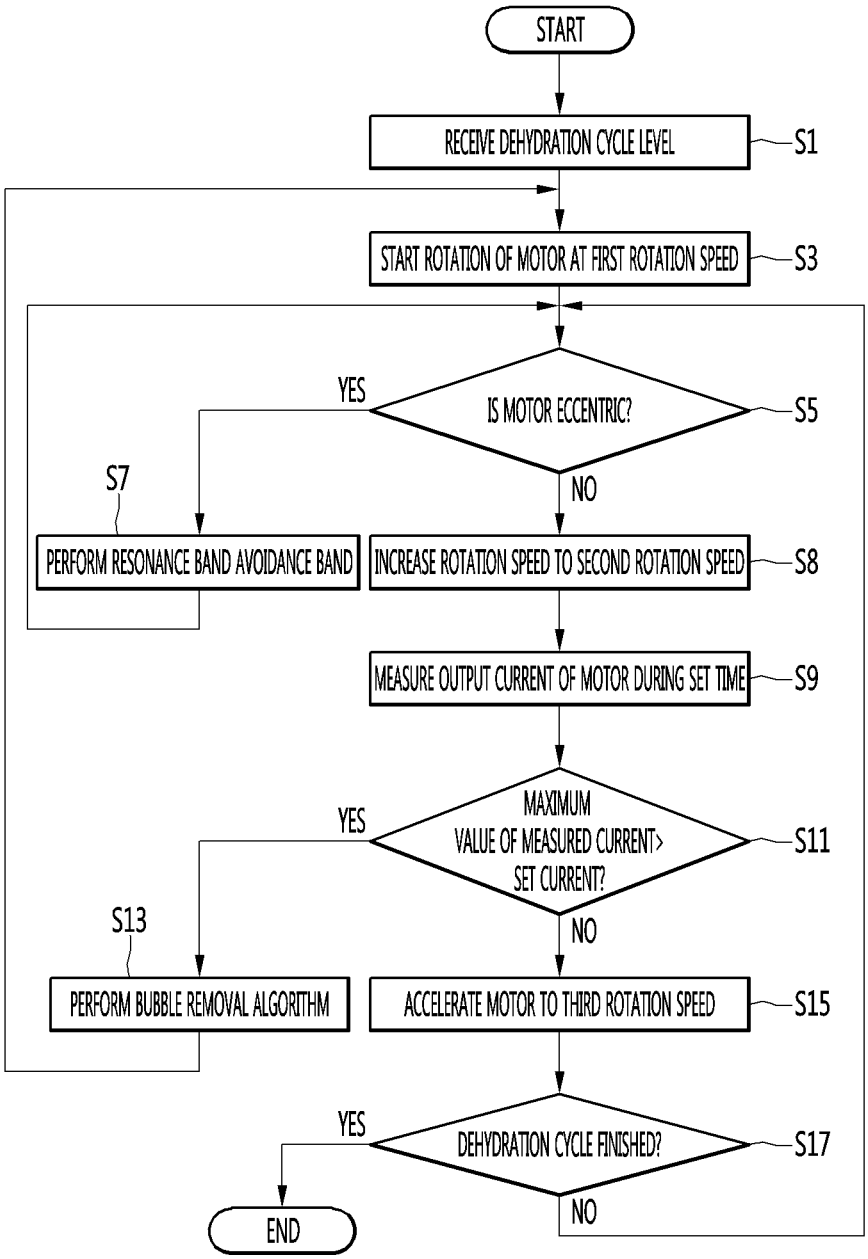
FIG. 5 is a flowchart illustrating a method of controlling a washing machine according to an embodiment.
Figure 6:
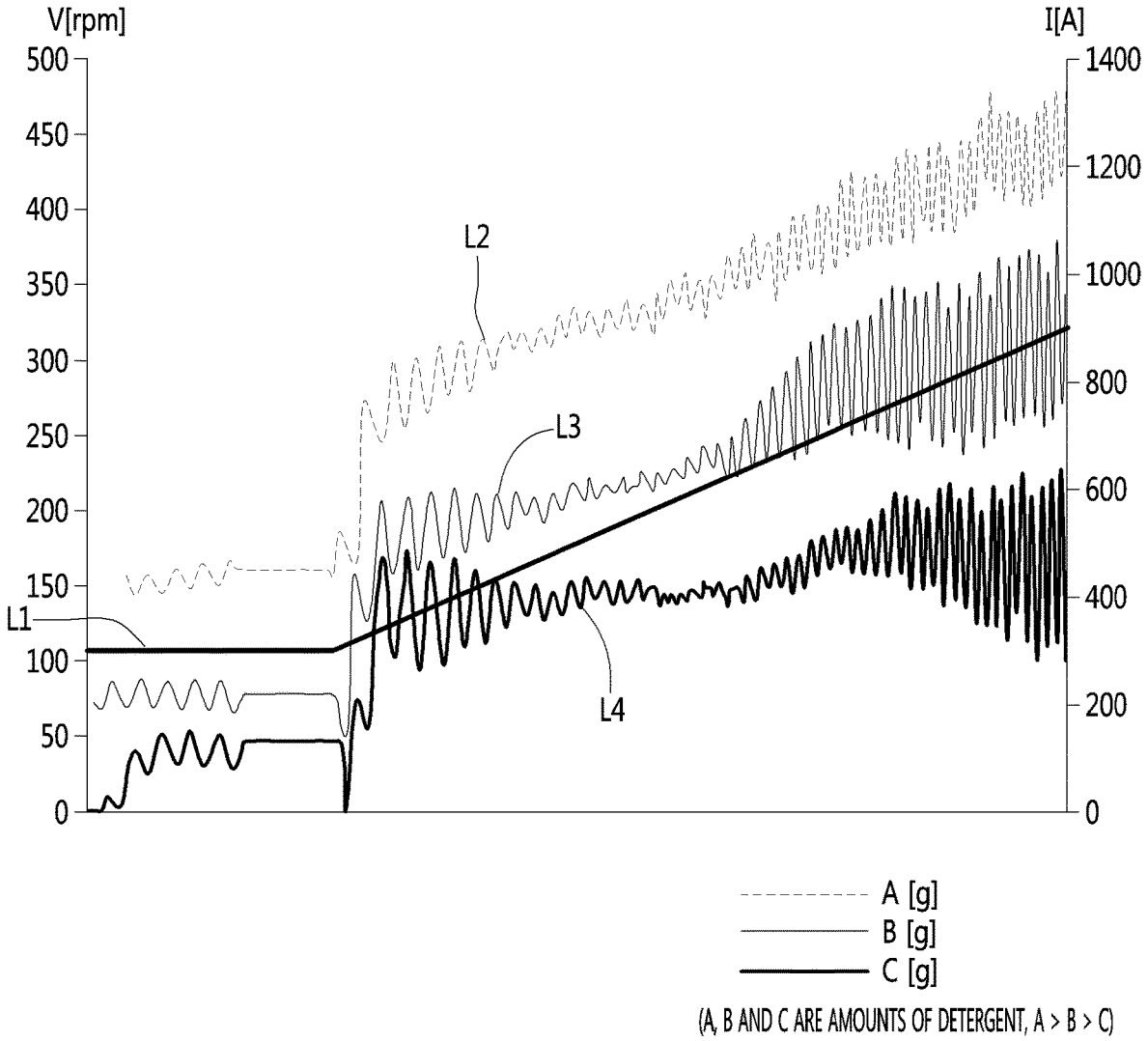
FIG. 6 is a graph showing the amount of current applied to a motor according to the rotation speed of the motor and the amount of detergent according to an embodiment.
Figure 7:
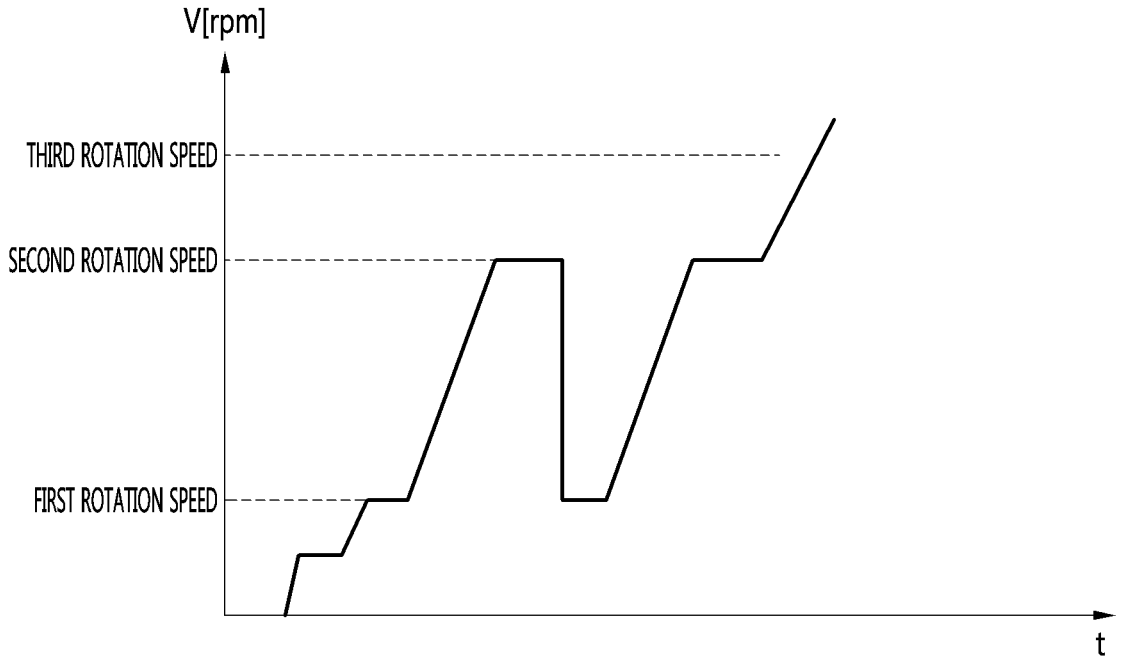
FIG. 7 is graph showing rotation speed periods of a motor according to an embodiment.

FIG. 5 is a flowchart illustrating a method of controlling a washing machine according to an embodiment, FIG. 6 is a graph showing the level of measured output current according to the amount of detergent according to an embodiment, and FIG. 7 is graph showing rotation speed periods of a motor according to an embodiment.

Referring to FIGS. 5 to 7, a dehydration cycle level may be input to the microcomputer 900 (S1). For example, the dehydration cycle level may be input through the input unit 200. In another example, the dehydration cycle level may be automatically input by a weight sensor (not shown) for measuring the weight of the drum 20.

The microcomputer 900 may drive the motor 30 at a rotation speed corresponding to the input dehydration cycle level (S3).

First, the microcomputer 900 may drive the motor 30, thereby rotating the motor at a first rotation speed. At this time, the rotation speed of the motor 30 may increase continuously or stepwise until the rotation speed of the motor 30 reaches the first rotation speed.

In the present embodiment, a period in which the motor 20 is driven at the first rotation speed may be referred to as a low-speed rotation period.

The microcomputer 900 may control the eccentricity detector 550 to check whether the drum 20 is eccentric (S5). While the motor 30 is accelerated to the first rotation speed or is rotated at a constant speed, the microcomputer 900 may check whether the drum 20 is eccentric through the eccentricity detector 550.

For example, the microcomputer 900 may check the degree of eccentricity of the drum 20 using the average of the change in current speed of the motor 30 and the reference speed change. In another example, the microcomputer 900 may check the degree of eccentricity of the drum 20 using the difference between the current speed of the motor 30 and the speed input to the motor 30. In another example, the microcomputer 900 may check whether the drum 20 is eccentric using the vibration sensor for measuring the amount of vibration of the drum 20 or the cabinet 10. Specifically, if the amount of vibration measured by the vibration sensor is greater than a set amount of vibration, the microcomputer 900 may recognize that the drum 20 is eccentric.

Upon determining that the drum 20 is eccentric, the microcomputer 900 may perform the resonance band avoidance algorithm (S7). Upon determining that the drum 20 is eccentric, the microcomputer 900 may recognize that the rotation speed of the motor 30 enters the resonance band. Accordingly, the microcomputer 900 may perform the resonance band avoidance algorithm and perform control such that the motor 30 deviates from the resonance band. For example, the resonance band avoidance algorithm may be understood as increasing or decreasing the speed of the motor 30 by a set rotation speed.

The microcomputer 900 may perform the resonance band avoidance algorithm until eccentricity of the drum 20 is corrected (S5 to S7).

Upon determining that the drum 20 is not eccentric, the microcomputer 900 may control the motor control device 500 to increase the speed of the motor 30 to the second rotation speed (S8).

When the rotation speed of the motor 30 reaches the second rotation speed, the microcomputer 900 may rotate the motor 30 at the second rotation speed for a set time. That is, the drum 20 may uniformly rotate at the second rotation speed for the set time.

Meanwhile, during the motor 30 being accelerated to the second rotation speed, the microcomputer 900 may check whether bubbles have been generated in the drum 20, or during the motor 30 being rotated at a constant speed after accelerating to the second rotation speed, the microcomputer 900 may check whether bubbles have been generated in the drum 20 using information on output current applied to the motor 30 (S9 to S11).

Specifically, the microcomputer 900 may control the current detector 540 to measure the output current i of the motor 30 (S9). Upon recognizing that the drum 20 rotates in a balanced state, the microcomputer 900 may control the current detector 540 to measure the output current i of the motor 30. In addition, the microcomputer 900 may select a maximum output current imax from among the output currents i measured during the set time.

The microcomputer 900 may compare the maximum output current imax with the set current Iset to check whether bubbles have been generated in the drum 20 (S11). The set current Iset may be a current value corresponding to the current speed of the motor 30 stored in the memory 700.

When the maximum output current imax is greater than the set current Iset, the microcomputer 900 may recognize that bubbles have been generated in the drum 20.

Referring to FIG. 6, a first solid line L1 denotes the speed of the motor 20. In addition, a second line L2, a third solid line L3 and a fourth solid line L4 denote the levels of the output current i measured according to the rotation speed of the motor 20.

The second line L2 denotes the output current when the amount of detergent is A. The third solid line L3 denotes the output current when the amount of detergent is B. The fourth solid line L4 denotes the output current when the amount of detergent is C. The amount A of detergent may be greater than the amount B of detergent. The amount B of detergent may be greater than the amount C of detergent. For example, the amount A of detergent may be 120 g, and the amount B of detergent may be 30 g. The amount of detergent may be 0 g, that is, a state in which detergent is not present.

As the amount of detergent remaining in the drum 20 increases, the amount of bubbles generated in the drum 20 may increase. It can be seen that, as the amount of bubbles increases, the level of the output current i measured by the current detector 540 may increase.

Accordingly, the microcomputer 900 may compare the maximum value imax (maximum output current) measured by the current detector with set current to check whether bubbles have been generated in the drum 20.

For example, the maximum current measured when the amount of detergent is B may be stored in the memory 700 as the set current Iset. In addition, the microcomputer 900 may recognize that bubbles have been generated in the drum 20, when the measured maximum output current imax is greater than the maximum current measured when the amount of current is B.

Referring to FIGS. 5 and 7, upon recognizing that bubbles have been generated in the drum 20, the microcomputer 900 may perform the bubble removal algorithm (S13).

The microcomputer 900 may stop rotation of the drum 20. In addition, the microcomputer 900 supplies clean water, in which detergent is not dissolved, into the drum 20, rinse the laundry, and perform dehydration again, thereby removing the detergent absorbed in the laundry.

When the bubble removal algorithm is completed, the microcomputer 900 may restart the original dehydration cycle (S3 to S11).

Upon recognizing that bubbles have not been generated in the drum 20 (normal state) while the motor 30 is accelerated to the second rotation speed and rotated at a constant speed, the microcomputer 900 may accelerate the motor 30 to the third rotation speed (S15). That is, the microcomputer 900 may recognize that bubbles have not been generated in the drum 20 and perform high-speed dehydration. At this time, the microcomputer 900 may immediately increase the rotation speed of the motor 30 from the second rotation speed to the third rotation speed or increase the rotation speed of the motor 30 after decreasing to the first rotation speed. For example, the motor 30 may be driven at the first rotation speed during a certain time after decreasing the rotation speed of the motor 30 from the second rotation speed to the first rotation speed. Then, the rotation speed of the motor 30 may increase from the first rotation speed to the second rotation speed. In addition, while the rotation speed of the motor 30 increases from the first rotation speed to the second rotation speed, the microcomputer 900 may determine whether bubbles are generated in the drum 20 again. In addition, after the motor 30 is driven at the second rotation speed for a certain time, the rotation speed of the motor 30 may increase to the third rotation speed or more.

The microcomputer 900 may check whether bubbles have been generated in the drum 20 again while the motor 30 is accelerated to the third rotation speed.

According to the present embodiment, it is possible to monitor whether bubbles have been generated in the drum 20 even when the drum 20 rotates at a low speed.

Upon recognizing that bubbles have been generated in the drum, the microcomputer 900 may perform the bubble removal algorithm to remove bubbles. That is, upon determining that bubbles have been generated in a low-speed period, it is possible to remove bubbles. Accordingly, at the time of high-speed dehydration, the motor 30 may rotate at a set rotation speed, thereby improving efficiency of the dehydration cycle.

In addition, since it is possible to reduce bubbles generated in the low-speed period, it is possible to reduce a phenomenon wherein bubbles in the drum 20 is leaked in a high-speed dehydration period.

What is claimed is:

1. A method of controlling a washing machine, the method comprising:

starting driving of a motor for rotating a drum of the washing machine and increasing a rotation speed of the motor to a first rotation speed;

uniformly rotating the motor at the first rotation speed during a first time when the rotation speed of the motor reaches the first rotation speed;

increasing the rotation speed of the motor from the first rotation speed to a second rotation speed, after the rotation speed of the motor have increased to the first rotation speed;

uniformly rotating the motor at the second rotation speed during a second time greater than the first time when the rotation speed of the motor reaches the second rotation speed;

determining, by a microcomputer, whether bubbles have been generated in the drum during at least the increasing of the rotation speed of the motor from the first rotation speed to the second rotation speed and during the uniformly rotating of the motor at the second rotation speed during the second time, wherein the determining by the microcomputer includes a current detector to obtain an output current of the motor, and the microcomputer to compare the output current and a set current in order to make the determination;

increasing the rotation speed of the motor from the second rotation speed to a third rotation speed upon the determination that the bubbles have not been generated in the drum; and performing an algorithm for removing the bubbles upon the determination that the bubbles have been generated in the drum, wherein a difference between the second rotation speed and the first rotation speed is greater than the first rotation speed.

2. The method of claim 1, wherein the first rotation speed is 100 rpm or more and the second rotation speed is 400 rpm or more.

3. The method of claim 1, wherein the second rotation speed is equal to or greater than three times the first rotation speed.

4. The method of claim 1, wherein the rotation speed of the motor increases stepwise to the first rotation speed.

5. The method of claim 1, wherein the algorithm includes:

stopping the motor in order to remove bubbles;

rotating the motor after water is supplied to the drum; and draining water in the drum after the motor rotates.

6. The method of claim 1, wherein a difference between the first rotation speed and the second rotation speed is greater than a difference between the second rotation speed and the third rotation speed.

7. The method of claim 1, wherein the microcomputer determines whether bubbles have been generated in the drum while the rotation speed of the motor increases from the second rotation speed to the third rotation speed, which is greater than the first rotation speed.

* * * * *